US009446890B1

(12) United States Patent
Morris, Jr.

(10) Patent No.: US 9,446,890 B1
(45) Date of Patent: Sep. 20, 2016

(54) RECTANGULAR PAIL WITH LOCKING LID

(71) Applicant: Glenn H. Morris, Jr., Chattanooga, TN (US)

(72) Inventor: Glenn H. Morris, Jr., Chattanooga, TN (US)

( * ) Notice: Subject to any disclaimer, the term of this patent is extended or adjusted under 35 U.S.C. 154(b) by 92 days.

(21) Appl. No.: 14/014,553

(22) Filed: Aug. 30, 2013

Related U.S. Application Data

(60) Provisional application No. 61/170,801, filed on Oct. 8, 2012.

(51) Int. Cl.
*B65D 51/20* (2006.01)
*B65D 51/22* (2006.01)
*B65D 43/22* (2006.01)

(52) U.S. Cl.
CPC ..... *B65D 51/22* (2013.01); *B65D 43/22* (2013.01)

(58) Field of Classification Search
CPC ..... B65D 51/22; B65D 43/22; B65D 55/06; B65D 55/0863; B65D 51/18; B65D 43/16; B65D 43/163; B65D 43/168
USPC ..... 292/80, 87, 91, 70, 76, 300, 303, 340, 292/302, 341.15, DIG. 11, DIG. 16, DIG. 38; 220/835, 254.3, 259.1, 847
See application file for complete search history.

(56) References Cited

U.S. PATENT DOCUMENTS 1,558,748 A * 10/1925 Muck ..... 292/175
3,415,412 A * 12/1968 Robinson et al. ..... 220/270
3,656,648 A * 4/1972 Powaloski et al. ..... 215/253
3,690,499 A * 9/1972 Westfall et al. ..... 215/253
3,744,655 A * 7/1973 Nixdorff, Jr. ..... 215/216
3,844,438 A * 10/1974 St. Pierre et al. ..... 215/221
3,866,782 A * 2/1975 Westfall ..... 215/253
3,902,620 A * 9/1975 McIntosh ..... 215/209
3,963,139 A * 6/1976 Gach ..... 215/216
4,036,385 A * 7/1977 Morris ..... B65D 50/046 215/209
4,154,353 A * 5/1979 Hoo ..... B65D 50/06 215/206
4,212,409 A * 7/1980 Jeppsson ..... 220/276
4,245,753 A * 1/1981 Ellis ..... 220/288
4,267,937 A * 5/1981 Piltz ..... B29C 45/14811 215/256
4,360,121 A * 11/1982 Helms ..... 220/270
4,512,484 A * 4/1985 Mar ..... 215/221
4,529,100 A * 7/1985 Ingemann ..... 220/270
4,560,076 A * 12/1985 Boik ..... 215/252
4,709,823 A * 12/1987 Beck et al. ..... 215/235
4,732,288 A * 3/1988 Morris, Sr. ..... 215/214
4,738,374 A * 4/1988 Ingemann ..... 220/258.2
4,782,977 A * 11/1988 Watanabe et al. ..... 220/324
4,925,041 A * 5/1990 Pehr ..... B65D 43/164 215/216
4,940,158 A * 7/1990 Farrell et al. ..... 220/258.2
4,967,926 A * 11/1990 Morris, Sr. ..... 220/323
5,125,538 A * 6/1992 Morris, Sr. ..... 222/143
5,147,060 A * 9/1992 Lima et al. ..... 220/288
5,328,046 A * 7/1994 Kutz et al. ..... 220/266
D351,791 S * 10/1994 Morris, Sr. ..... D9/425
5,377,858 A * 1/1995 Morris, Sr. ..... 220/254.8
5,544,768 A * 8/1996 Gargione ..... B65D 50/046 215/209
5,579,957 A * 12/1996 Gentile et al. ..... 222/153.14
5,692,635 A * 12/1997 Farrell et al. ..... 220/270

(Continued)

*Primary Examiner* — Nathan J Newhouse
*Assistant Examiner* — Jennifer N Zettl
(74) *Attorney, Agent, or Firm* — Stephen J. Stark; Miller & Miller PLLC

(57) ABSTRACT

A container having a locking lid assembly preferably provides a container which receives a lid with a hinged top. The lid may have a tamper indicator and the top preferably cooperates with the container to lock the top in a closed or locked configuration.

18 Claims, 3 Drawing Sheets

(56) References Cited

U.S. PATENT DOCUMENTS 5,785,203 A * 7/1998 Arshinoff ..... B65D 25/325 220/266
5,893,475 A * 4/1999 May ..... 215/252
5,915,575 A * 6/1999 Morris, Sr. ..... 215/214
6,006,942 A * 12/1999 Morris et al. ..... 220/288
6,105,809 A * 8/2000 Yamanaka ..... A47J 36/06 16/257
6,170,691 B1 * 1/2001 Morris et al. ..... 220/304
7,261,332 B1 * 8/2007 Petersen et al. ..... 292/121
8,235,233 B2 * 8/2012 Pehr ..... 215/237
8,262,142 B2 * 9/2012 Ramsauer ..... 292/163
8,286,819 B1 * 10/2012 Morris, Jr. ..... B65D 50/048 220/302
8,308,008 B2 * 11/2012 Perry ..... B65D 43/169 206/508
8,474,644 B1 * 7/2013 Morris, Jr. ..... 220/288
8,528,772 B1 * 9/2013 Morris, Jr. ..... B65D 45/16 206/506
D706,509 S * 6/2014 Morris, Jr. ..... D32/53
8,777,041 B1 * 7/2014 Morris, Jr. ..... 220/288
2003/0222084 A1 * 12/2003 Morris, Jr. ..... 220/284
2004/0007576 A1 * 1/2004 Morris, Sr. ..... 220/288
2004/0020929 A1 * 2/2004 Morris, Sr. ..... 220/288
2004/0200839 A1 * 10/2004 Conti ..... 220/288
2007/0039964 A1 * 2/2007 Morris ..... B65D 50/046 220/302
2008/0156806 A1 * 7/2008 Perry ..... B65D 25/2897 220/361
2010/0072211 A1 * 3/2010 Dickinson ..... B65D 43/16 220/592.27
2014/0069919 A1 * 3/2014 Robert et al. ..... 220/258.2

* cited by examiner

RECTANGULAR PAIL WITH LOCKING LID

CLAIM OF PRIORITY

This application claims the benefit of U.S. Provisional Patent Application No. 61/710,801 filed Oct. 8, 2012 which is incorporated in its entirety herein by reference.

FIELD OF THE INVENTION

The present invention relates to a substantially rectangular cross-section container having a locking lid, and more particularly to a lid with a first locking mechanism portion connected to a rim of the lid and a second locking mechanism portion connected to a top hingedly connected to the rim, and for at least some embodiments, a tamper indicator located internal to the top and rim.

DESCRIPTION OF RELATED ART

The applicant and other companies have developed a number of locking lid pail constructions. Some of these locking lids include triggers or operators which release locking lids from a locked configuration. Mechanisms have been operably coupled to the pail such as provided in U.S. Pat. No. 7,513,384 incorporated in its entirety herein by reference. Others such as is shown in U.S. Pat. Nos. 6,776,302 and 5,147,060 have a locking mechanism operably coupled to the lid which engages one or more stops on the container. Some of the prior art lid with locking mechanisms have a locking lid mechanism which engages inwardly directed teeth from a container. At least U.S. Pat. No. 6,776,302 has outwardly directed teeth on the container. However, even with these improvements over other prior art constructions, there exists a need to be able to provide a more effective design for at least some particular uses.

SUMMARY OF THE INVENTION

Accordingly, it is the present object of the present invention to provide an improved container having a locking lid.

It is another object of at least some embodiments to provide an improved container with a lid with a first locking mechanism portion retained in a side wall of a rim of the lid or container which engages a second locking mechanism portion on the downwardly depending from a top of the lid.

It is another object of at least some embodiments of the present invention to provide an improved container with locking lid wherein the plurality of stops of the second locking portion cooperate with the first locking mechanism which receive an abutment of the locking mechanism moving downwardly from above with the stops preferably provided on a downwardly depending protrusion of the second locking portion.

It is an object of at least some embodiments of the present invention to provide a first locking mechanism which connects to a lid provides a linearly actuated abutment which engages at least one stop in a targeted direction or laterally relative to a side wall of the lid or container if not radial in nature.

Accordingly, in accordance with a presently preferred embodiment of the present invention, a container assembly can be provided comprising a lid and an open ended container. A first locking mechanism is provided operably connected to a rim (of the lid, although other embodiments could provide the rim on the container) which cooperates with at least one second locking member connected to a top of the lid. The top is preferably hingedly connected to the rim. The locking mechanism can be used to assist in retaining the lid on the container in a locking configuration, and by de-activating the locking mechanism allows the subsequent opening of the top relative to the container. By moving the first locking member to a disengaged configuration, the second locking member may be disengaged from the first locking member in some embodiments. The top of the lid may then be pivoted about a hinged connection relative to the rim to be open the lid relative to the container.

In a presently preferred embodiment of the present invention, the second locking member can be operably connected to a downwardly depending side wall of the lid and may be provided in the form of a linearly operable slide which provides or is connected to an abutment. The slide operates laterally or parallel to the rim at its location (tangentially if the rim is radial). Stops, such as portions of teeth having angled surfaces directed towards the slide are preferably provided as a second locking member and cooperate with an abutment of the first locking mechanism particularly when the abutment is biased in a direction there against such as by the slide. Disengaging the locking mechanisms may then allow lifting upwardly of a top hingedly connected to the rim.

Locking member can preferably be disengaged by laterally or tangentially moving the slide wherein the abutment disengages the at least one stop thereby allowing lifting of the top of the lid in a direction upwardly, previously prevented by the engagement of the abutment with at least one of the stop(s).

The teeth of the second locking member are preferably laterally extending and can, for at least some embodiments, form a portion of a downward protrusion from a top of the lid in some embodiments. Using more than one teeth allows for incremental tightening capability of the lid relative to the container. When the first locking member engages a stop, it can provide a locked configuration as would be understood by those of ordinary skill in the art and as described above to then prevent upward movement of the top of the lid without first disengaging the first and second locking members.

Although the presently preferred embodiment of the first locking member includes a slide which may also provide an actuator which may be useful to move the abutment from the stop, other embodiments may be constructed in other manners. Furthermore, the preferred embodiment may include a first locking mechanism which is restrained to the downwardly depending rim of the lid. Other embodiments may provide a first locking mechanisms connected to other portions of the lid or container. Finally, the stops may preferably be accessible to an abutment from the side and may be engaged from a laterally or tangentially extending and moving abutment.

Internal to the rim and/or below the top for at least some embodiments, or at least portions of the rim, is a tamper indicator. The temper indicator may, or may not, be molded with the lid, such as internal to the rim with a pull tab, possibly molded into a pocket found in the tamper indicator. Other tamper indicators could be provided with other embodiments. This construction has been found to increase the structural integrity of the lid/container combination when shipped with product from a customer of the applicant. Other tamper indicators could be used with other embodiments.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
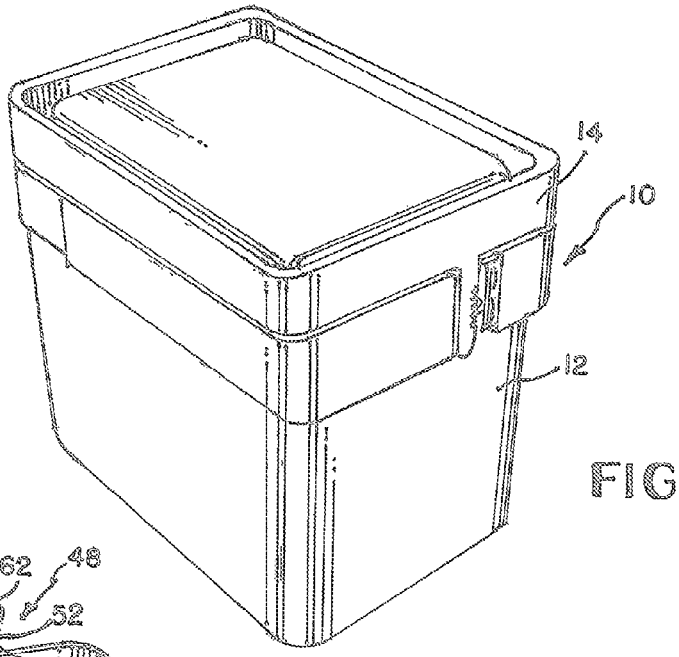
FIG. 1 is a top perspective view of a rectangular pail embodying my new design in a closed configuration.
Figure 2:
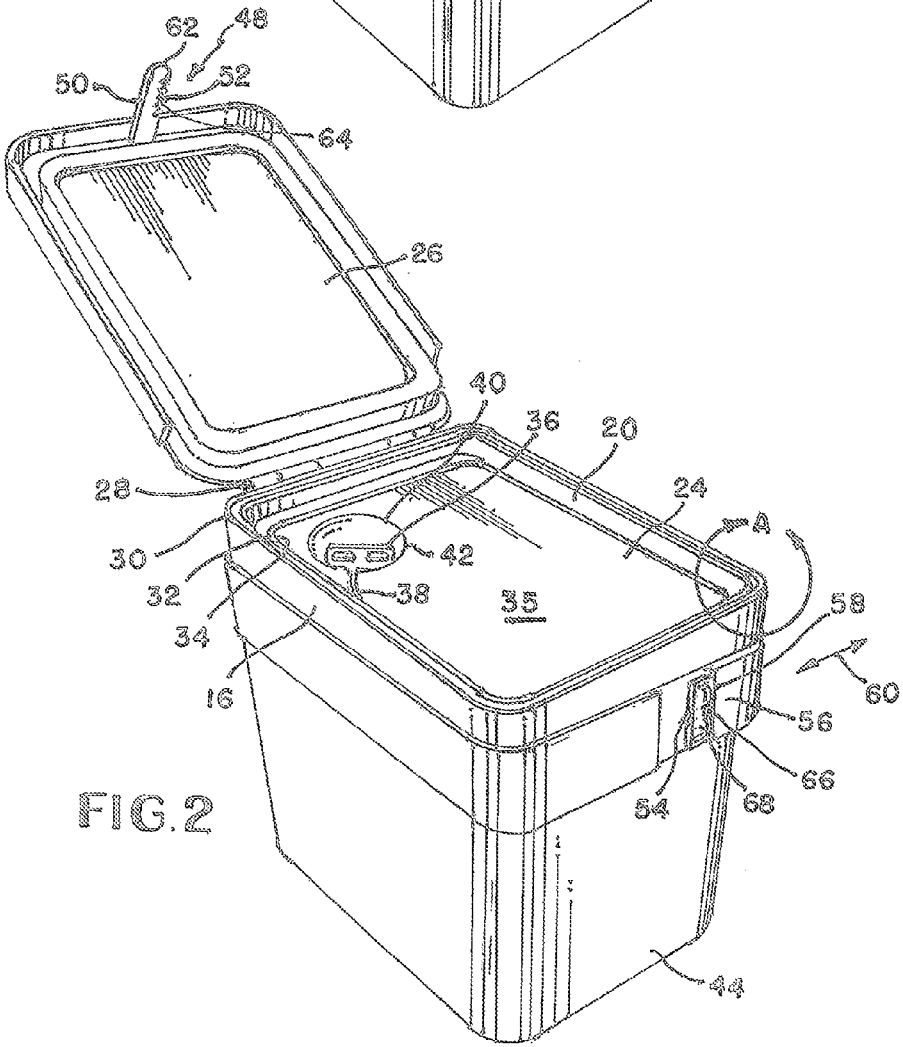
FIG. 2 is a top perspective view in an open configuration thereof.
Figure 3:
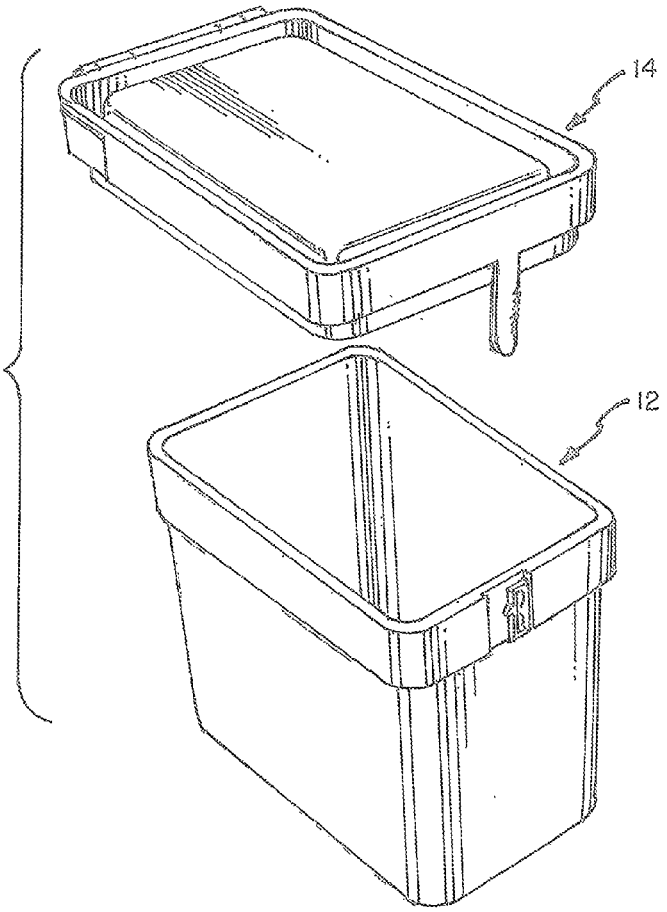
FIG. 3 is an exploded view thereof in an open configuration.
Figure 4:
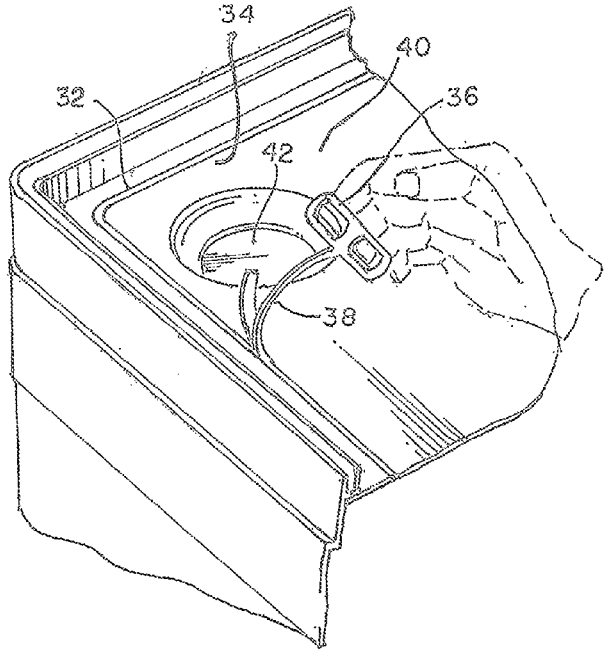
FIG. 4 is a top perspective detailed view of the handle and tear strip in operation to remove the tear out portion of the tamper indicator.
Figure 5:
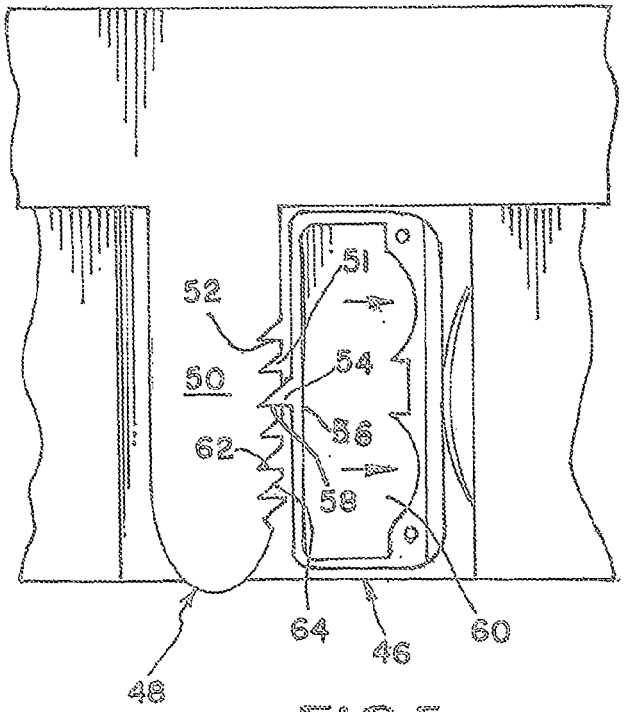
FIG. 5 is a detailed front plan view of detail A shown in FIG. 2.
Figure 6:
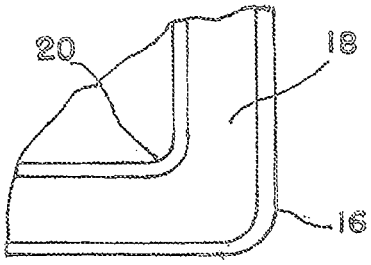
FIG. 6 is a bottom view of detail A of a portion of the lid 14 shown in FIGS. 1-3.

The figures show a container assembly 10 having a container 12 connectable to a lid 14. The lid 14 is preferably constructed to have a rim 16 which is downwardly depending and preferably provides a first side defining a groove at 18 with an interior wall 20. The groove 18 preferably receives a bead 22 or upper lip of the container 12 and secures the lid 14 to the container 12. It is preferred that many manufacturers will press the lid 14 onto the container 12 after filling the container 12 with product after press fitting the lid 14 on the container 12 the product is then ready for delivery to customers with a tamper indicator 24 or other tamper indicator to be available to show customers whether or not the product has been the subject of tampering. More about the tampering indicator 24 will be discussed below. The top 26 is shown in an open configuration as illustrated in FIG. 2, but it may be a closed configuration as shown in other figures, such as FIG. 1.

Figure 7:
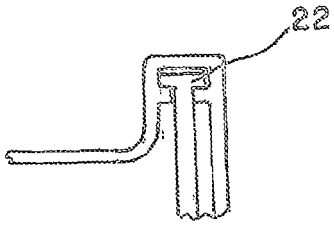
FIG. 7 is a cross sectional view of detail A shown in FIG. 2.

With the top 26 in the open configuration as illustrated in FIG. 7, the top 26 is preferably hingedly connection at hinge 28 to rim 16 such as at ledge 30. Hinge 28 is preferably an integral hinge although in other embodiments it could be provided with a separate components such as a rod which cooperates with bores in the top 26 and/or as connected to the ledge 30. In the illustrated instructions, the top 26 rotates or pivots about the hinge 28 between the open and closed configurations.

In the preferred embodiment, the tamper indicator 24 has been integrally molded with the formation of at least the interior wall 20 of the lid 14. In fact, when the hinge 28 is integrally molded with the top 26, it has been found convenient to make entire lid 14 in a single molding process. The tamper indicator 24 can be a plastic molded piece that has tear lines 32,34 which either extend directly from inner wall 20 or from base 35 of the lid 14. A handle 36 preferably connects to tear strip 38 to allow a user to begin the process of pulling the tear strip 38 which separates the tear lines 32,34.

Pulling the tear strip 38 out and thus remove the tamper indicator 24 allows the user to access the contents of the container 12 preferably after purchasing a filled container assembly 10 at a retail or other establishment. The handle 36 may be preferably located below an upper surface 40 defining a pocket 42 and the tear strip 38. The handle 36 for at least some embodiments may not extend initially above the upper surface 40 while still able to be easily grasped by a user for pulling the tear strip 38 out, as would be understood by those of ordinary-skill in the art. The pocket 42 preferably extends below a bottom elevation of the inner wall 20 as well as below the rim 16.

The interior wall 20 is preferably parallel to the rim 16 and the ledge 30 is preferably perpendicular to both interior wall 20 and rim 16. Other embodiments may have different constructions.

At a front 44 of the lid 14 is preferably located a first locking mechanism 46 which cooperates with a portion of the second locking member portion 48 connected to the top 26. In one embodiment, the second locking member portion 48 resembles a blade 50 having a series of teeth 52 which are preferably shaped to cooperate with at least one stop 54 illustrated as an abutment 56 having a front bladed edge 58 which is preferably operably coupled to the rim 16 so that it can move in a lateral direction 60 in and out of engagement with one or more stops or teeth 52 as illustrated. A series of teeth can be utilized having stop surfaces 62 and angled surfaces 64. One of ordinary skill in the art will see if that the top 26 is shut relative to the rim 16, the first and second member portions 46,48 cooperate. The angled front blade edge 51 of the first locking mechanism stop 54 allows the user to incrementally tighten the top 26 relative to the rim 16 and/or container 12 when shutting the top 26 relative to the rim 16 and/or container 12.

Although the rim 16 is shown as integrally connected to an integral portion of the lid 14, the rim 16 may be a separate part of the container 12 relative to the top 26. The stop 54 can be moved laterally 60 or tangentially, particularly if the rim 16 is round and in and out of engagement with at least one stop 52. The stop 54 is preferably biased into locking engagement with the second locking mechanism 48. In order to disengage the second locking mechanism 48 from the first locking mechanism portion 46, the bias member 66 must preferably be overcome such as by operating the slide 68 to overcome the bias member 66 to move the abutment 54 out of engagement with the at least one stop 52 thereby allowing the top 26 to rotate relative to the hinge member 28 out of the locked and/or closed configuration to be open. Other embodiments may operate differently. Removing the tamper indicator 24 if not already removed allows access to the interior contents stored in the container 12.

Of course, other tamper indicators could be utilized whether they prevent movement of the first locking member portion 46 or other tamper indicators as are known in the art could also be employed.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A container assembly comprising:

a container having upwardly extending walls defining a volume therein with the walls ending at an upper lip at a bead, said container and the lip defining a rectangular perimeter about the walls;

a lid connected to the container, said lid having a peripheral rim which cooperates with an interior wall of the lid to provide a groove therebetween, with the upper lip of the container received within the groove with the bead securing the lid to the container, when installed;

a top connected to the lid at a pivot, said top providing a second locking member portion in the form of a downwardly directed blade having a plurality of teeth thereon which cooperates with a first locking member portion connected to one of the walls of the container and spaced from the lip biased horizontally to provide a locked configuration with the top locked shut relative to the top and container.

2. The container assembly of claim 1 wherein the first locking member portion is located below the upper lip of the container.

3. The container assembly of claim 1 wherein the top is connected at a pivot to a peripheral edge of the lid.

4. A container assembly comprising a container having upwardly extending walls defining a volume therein with the walls ending at an upper lip defining a perimeter;

a lid connected to the container, said lid having a peripheral rim which cooperates with an interior wall of the lid to provide a groove therebetween, with the upper lip of the container received within the groove, when installed;

a top connected to the lid at a pivot, said top providing a second locking member portion which cooperates with a first locking member portion connected to the container and spaced below the lip to provide a locked configuration with the top locked shut relative to the top and container;

wherein the second locking member portion has a plurality of laterally directed teeth, at least one of which cooperates with at least one stop of the first locking member in the locked configuration, and said at least one stop is operably coupled to an exterior surface of the wall opposite the volume of the container.

5. The container assembly of claim 4 wherein the teeth are disposed on a downwardly directed blade.

6. The container assembly of claim 4 wherein the teeth have an angled face terminating at a stop.

7. The container assembly of claim 4 wherein the container has a tampered condition with a tamper indicator is removed to reveal the tampered condition.

8. The container assembly of claim 7 wherein the tamper indicator is located under the top.

9. The container assembly of claim 7 wherein the tamper indicator further comprises a tear out portion of the lid disposed internally to the rim, said tear out portion disposed parallel to the top when in a closed configuration.

10. The container assembly of claim 9 further comprising a handle located in pocket below an upper surface of the tear out portion, handle pulls tear strip to remove the tear out portion.

11. A container assembly comprising:

a container having upwardly extending walls defining a volume therein with the walls ending at an upper lip defining a perimeter;

a lid connected to the container, said lid having a peripheral rim which cooperates with an interior wall of the lid to provide a groove therebetween, with the upper lip of the container received within the groove, when installed;

a top connected to the lid at a pivot, said top providing a second locking member portion having a plurality of teeth which cooperates with a first locking member portion connected to the container and spaced from the lip to provide a locked configuration with the top locked shut relative to the top and container;

wherein the first locking member portion has an abutment extending from a forward vertical edge and is moved horizontally in a direction parallel to lip to disengage the locking member portions to provide an unlocked configuration.

12. The container assembly of claim 1 wherein the groove circumnavigates around and about the perimeter of the lip.

13. A container assembly comprising:

a container having upwardly extending walls ending at an upper lip defining a volume therein;

a lid connected to the container at a rectangular perimeter of the container, a top connected to the lid at a pivot along a perimeter edge of the lid, said top providing a second locking member portion having a plurality of teeth, at least one of said teeth which cooperate with a stop of a first locking member portion of the container to provide a locked configuration with the top locked shut relative to the top and container;

wherein the first member locking portion is spaced below the lip of the container in both the locked and unlocked configuration.

14. The container assembly of claim 13 further comprising a tamper indicator operably coupled to the lid below the top and when the tamper indicator is operated to reveal the tampered status a tampered configuration is provided.

15. The container assembly of claim 13 wherein said lid has a peripheral rim which cooperates with an interior wall of the lid to provide a groove therebetween, with the upper lip of the container having a bead received within the groove securing the lid to the container, when installed.

16. A container assembly comprising:

a container having upwardly extending walls ending at an upper lip, said container and lip each having a rectangular perimeter and the container defining a volume therein;

a lid connected to the container, a top connected to the lid at a pivot, said top providing a first second locking member portion having a plurality of teeth, at least one of which cooperates with a second first locking member portion of the container to provide a locked configuration with the top locked shut relative to the top and container; wherein the first member locking portion is spaced below the lip of the container in both the locked and unlocked configuration and a tamper indicator initially connected to the lid, said tamper indicator providing a tear out portion disposed parallel to the top and below the top, said tear out portion removed by a user to reveal a tampered condition.

17. The container assembly of claim 16 wherein the pivot is provided along a perimeter edge of the lid.

18. The container assembly of claim 16 wherein said lid has a peripheral rim which cooperates with an interior wall of the lid to provide a groove therebetween, with the upper lip of the container forming a bead which is received within the groove to connect the lid to the container, when installed.

* * * * *